US008887933B2

(12) United States Patent
Hanahara

(10) Patent No.: US 8,887,933 B2
(45) Date of Patent: Nov. 18, 2014

(54) COUNTERWEIGHT SUSPENSION DEVICE AND MOBILE CRANE

(75) Inventor: Akira Hanahara, Chita-gun (JP)

(73) Assignee: Hitachi Sumitomo Heavy Industries Construction Crane Co., Ltd., Tokyo (JP)

( * ) Notice: Subject to any disclaimer, the term of this patent is extended or adjusted under 35 U.S.C. 154(b) by 533 days.

(21) Appl. No.: 12/979,662

(22) Filed: Dec. 28, 2010

(65) Prior Publication Data

US 2011/0155681 A1 Jun. 30, 2011

(30) Foreign Application Priority Data

Dec. 28, 2009 (JP) ..... 2009-297806

(51) Int. Cl.
*B66C 23/76* (2006.01)
*B66C 23/74* (2006.01)

(52) U.S. Cl.
CPC ..... *B66C 23/74* (2013.01)
USPC ..... 212/196

(58) Field of Classification Search
USPC ..... 212/279, 276, 277, 195–198, 308
See application file for complete search history.

(56) References Cited

U.S. PATENT DOCUMENTS 4,711,358 A * 12/1987 Konishi ..... 212/178
5,460,001 A * 10/1995 Kato et al. ..... 60/426

FOREIGN PATENT DOCUMENTS

JP 55-89192 A 7/1980
JP 8-59184 A 3/1996
JP 9-78629 A 3/1997
JP 9-315776 A 12/1997
JP 9-328293 A 12/1997
JP 9-328294 A 12/1997
JP 9-328295 A 12/1997
JP 2000-136547 A 5/2000
JP 2008-297112 A 12/2008

OTHER PUBLICATIONS

Japanese-language Office Action dated Apr. 23, 2013 with English translation (6 pages).

* cited by examiner

*Primary Examiner* — Emmanuel M Marcelo
*Assistant Examiner* — Angela Caligiuri
(74) *Attorney, Agent, or Firm* — Crowell & Moring LLP

(57) ABSTRACT

A counterweight suspension device includes a pair of suspension cylinders that suspends a counterweight and that are hung from first and second hanging points provided separately in a left and right direction at a top end of a rear mast. A coupling member couples cylinder rod ends of the pair with each other. A lifting member lifts the counterweight. First and second connection points of the counterweight are connected with each of the cylinder rod ends, with the first and the second connection points provided separately in the left and right direction on the counterweight for attaching the lifting member to the counterweight. A first communication circuit is provided through which rod chambers of the suspension cylinders communicate with each other. A second communication circuit is provided through which bottom chambers of the suspension cylinders communicate with each other.

7 Claims, 6 Drawing Sheets

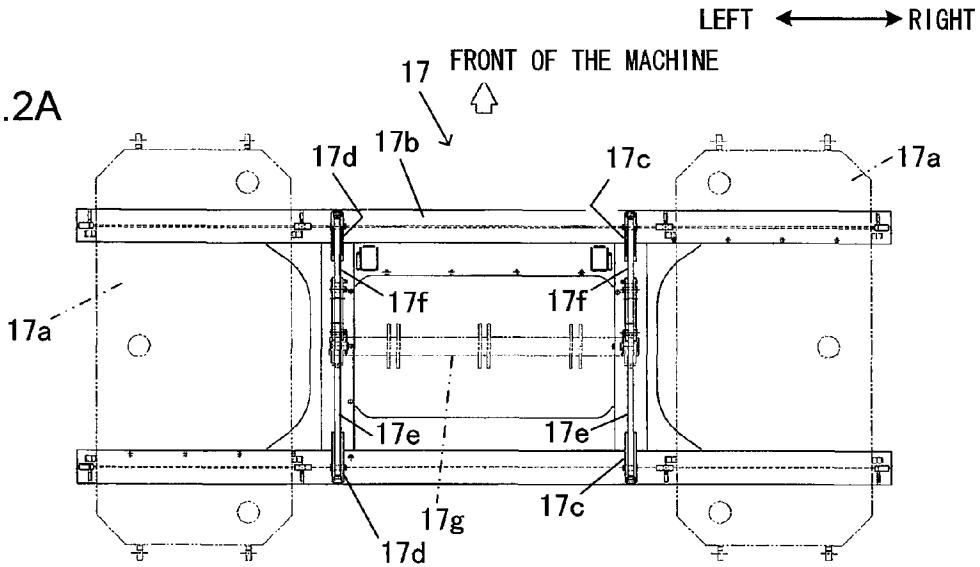
FIG.2A
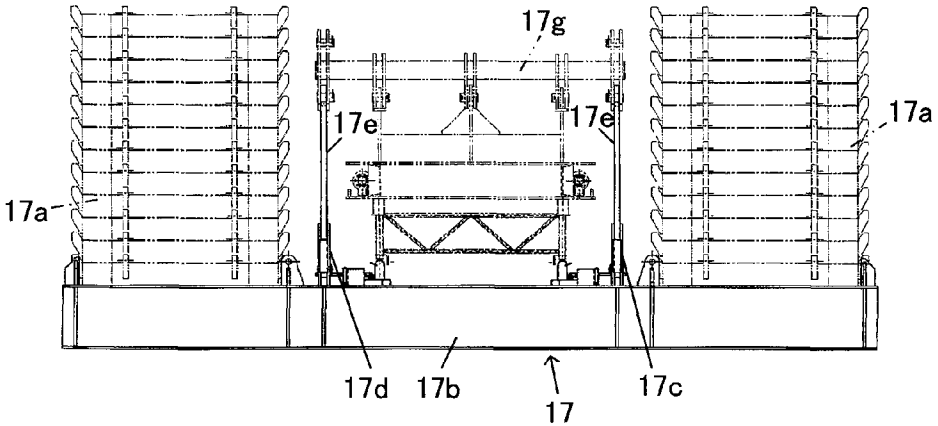
FIG.2B
FIG.2C

COUNTERWEIGHT SUSPENSION DEVICE AND MOBILE CRANE

INCORPORATION BY REFERENCE

The disclosure of the following priority application is herein incorporated by reference:

Japanese Patent Application No. 2009-297806 filed Dec. 28, 2009

BACKGROUND OF THE INVENTION

1. Field of the Invention

The present invention relates to a counterweight suspension device and a mobile crane including the counterweight suspension device.

2. Description of Related Art

Japanese Laid Open Patent Publication No. 2008-297112 discloses a crane that suspends a counterweight at a position a predetermined distance away from the rear end of a rotating superstructure so as to balance with load. In such crane, a mounting platform on which a plurality of weights are mounted is grounded when unloaded, whilst the plurality of weights are suspended together with the mounting platform when loaded, thereby balancing.

SUMMARY OF THE INVENTION

In the crane stated above, however, offset in the position at which the weights are mounted on the mounting platform causes offset in the center of gravity of the whole counterweight, which may result in the mounting platform leaning when the load is suspended. In such a case, it is required to reload each of the weights so as to modify a position of the center of gravity which has been deviated horizontally, which is inefficient.

A counterweight suspension device according to a first aspect of the present invention comprises: a pair of suspension cylinders that suspends a counterweight, and that are hung from a first and a second hanging points provided separately in a left and right direction at a top end of a rear mast; a coupling member that couples cylinder rod ends of the pair of suspension cylinders with each other; a lifting member for lifting the counterweight, that connects a first and a second connection points of the counterweight with each of the cylinder rod ends of the pair of suspension cylinders, with the first and the second connection points provided separately in the left and right direction on the counterweight for attaching the lifting member to the counterweight; a first communication circuit through which rod chambers of the pair of suspension cylinders communicate with each other; and a second communication circuit through which bottom chambers of the pair of suspension cylinders communicate with each other.

According to a second aspect of the present invention, in the counterweight suspension device according to the first aspect, it is preferable that a length of the coupling member is defined so that both ends of the coupling member are placed outside of a space defined between straight lines connecting the first and the second hanging points with the first and the second connection points, respectively.

According to a third aspect of the present invention, the counterweight suspension device according to the second aspect may further comprise an upper coupling member, which is shorter than the coupling member, that couples cap ends of the pair of suspension cylinders with each other.

According to a fourth aspect of the present invention, in the counterweight suspension device according to the first aspect, it is preferable that the suspension cylinders are held swingably in the left and right direction.

According to a fifth aspect of the present invention, in the counterweight suspension device according to the first aspect, a length of the coupling member may be equal to a distance between the first and the second connection points.

A mobile crane according to a sixth aspect of the present invention comprises: the counterweight suspension device according to the first aspect; a traveling undercarriage; a rotating superstructure that is provided rotatably upon the traveling undercarriage; the rear mast that is attached to the rotating superstructure; and a connection beam that allows the counterweight to move in an up and down direction and constrains the counterweight from moving in the left and right direction with respect to the rotating superstructure.

According to a seventh aspect of the present invention, the mobile crane according to the sixth aspect may further comprise: a boom that is attached to the rotating superstructure; and a supporting pendant rope that connects a top end of the boom with the rear mast.

BRIEF DESCRIPTION OF THE DRAWINGS

FIGS. 2A to 2C show a top view, a rear view and a right side view of an external weight.

DESCRIPTION OF PREFERRED EMBODIMENTS

Figure 1:
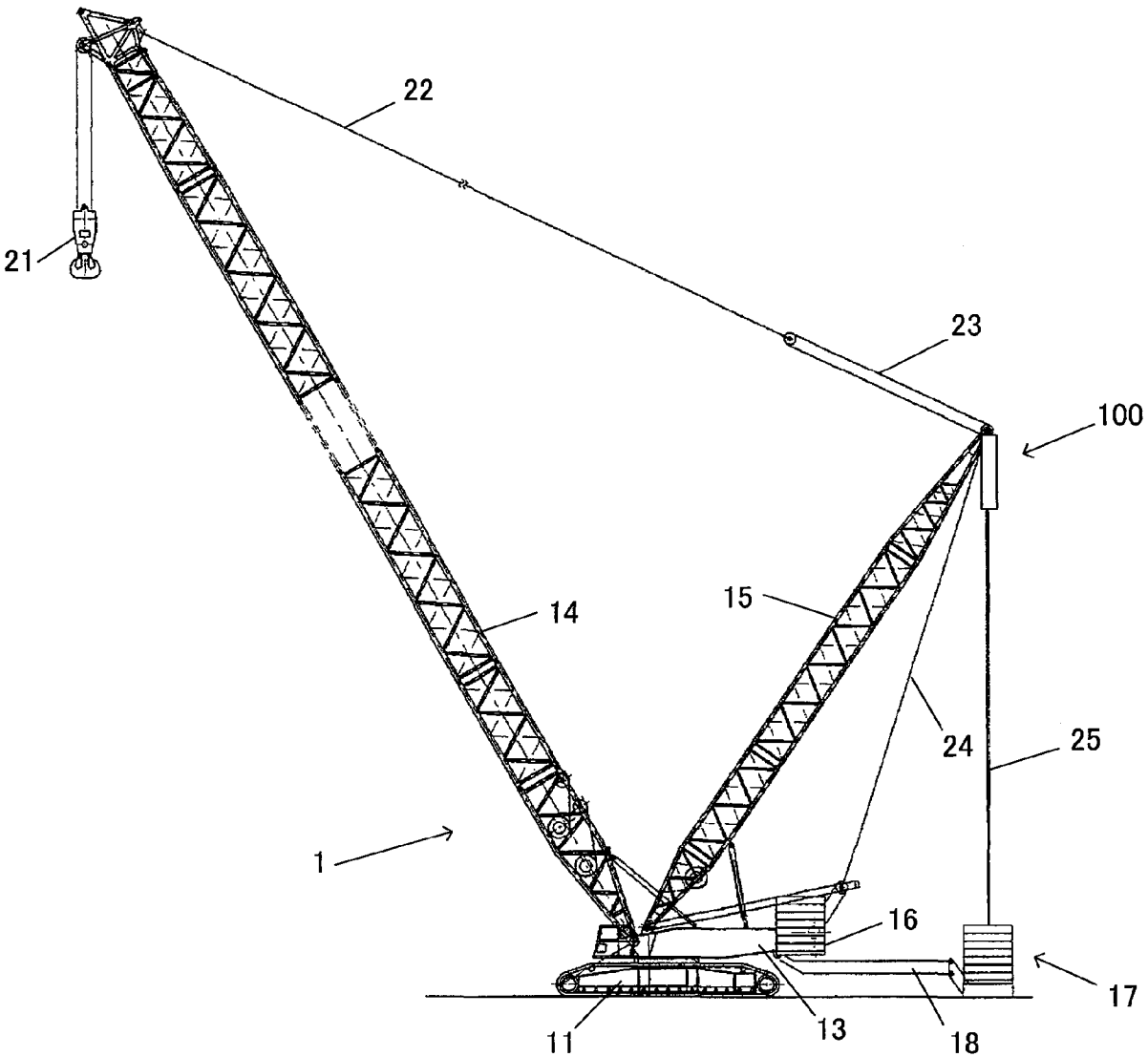
FIG. 1 is a side view of a mobile crane of an embodiment of a counterweight suspension device and a mobile crane according to the present invention.

An embodiment of a counterweight suspension device and a mobile crane according to the present invention will now be explained with reference to FIGS. 1 to 6. FIG. 1 is a side view of the mobile crane of the present embodiment. A mobile crane 1 includes a traveling undercarriage (or a traveling body) 11, a rotating superstructure (or a rotating body) 13 rotatably mounted on the traveling body 11, a boom 14 and a rear mast 15 pivotally coupled to the top end portion of the rotating body 13, and a counterweight 16 attached to the rear end portion of the rotating body 13. In addition, the crane 1 includes, separately from the counterweight 16, a counterweight (or an external weight) 17 to be suspended from the top end of the rear mast 15 leaning rearward at a position a predetermined distance away from the rear end of the rotating body 13. In the following explanation, for ease of comprehension, the "right side" and the "left side" refer to the right side and the left side, respectively, of the rotating body 13 viewed from the rear to the front.

FIGS. 2A to 2C are illustrations of the external weight 17. FIG. 2A is a top view, FIG. 2B is a rear view, and FIG. 2C is a right side view. It is to be noted that in FIGS. 2A and 2B weight members 17*a* described below are illustrated in a two-dot chain line and in FIG. 2C illustration of the weight members 17*a* is curtailed. The external weight 17 includes a plurality of weight members 17*a* and a ladder-like mounting platform (tray) 17*b* on which the weight members 17*a* are to be mounted. The weight of the whole external weight 17 can be adjusted by changing the number of the weight members 17*a* mounted thereon, and a number of the weight members 17*a* according to the weight of the load suspended by the crane 1 are stacked on the tray 17*b*. The tray 17*b* is provided with right connection points 17*c* and left connection points 17*d* for suspension by a suspension device 100 described later.

The right connection points 17*c* and the left connection points 17*d* are provided separately in the right and left direction on the top surface of the tray 17*b*. The right connection points 17*c* and the left connection points 17*d* are each provided at two positions in the fore-and-aft direction. One end, that is, a bottom end of a suspending rod 17*e* and one end, that is, a bottom end of a suspending rod 17*f* are connected to the right connection points 17*c*. The other end, that is, a top end of the suspending rod 17*e* is coupled with the other end, that is, a top end of the suspending rod 17*f*. A connection point 17*p* coupling the other ends of the suspending rods 17*e* and 17*f* are connected to the bottom end of a pendant rope 25 described later. The same is true for the left connection points 17*d*. The other ends of the right suspending rods 17*e* and 17*f* are coupled with the other ends of the left suspending rods 17*e* and 17*f* through a rod 17*g* so as to maintain a distance therebetween. It is to be noted that the external weight 17 is symmetrically arranged.

A connection beam 18 is attached to the rotating body 13 as shown in FIG. 1. The connection beam 18 allows the external weight 17 to move in the up and down direction or a vertical direction and prohibits the external weight 17 to move in the left and right direction or a horizontal direction with respect to the rotating body 13.

A hook 21 is suspended from the top end of the boom 14 and a hook rope is wound around a winch unit not shown in the figures. One end of a boom pendant rope 22 is fastened to the rear portion of the top end of the boom 14, and the other end of the boom pendant rope 22 is connected to a boom hoist rope 23. The boom hoist rope 23 is wound around the winch unit. A numeral 24 represents a supporting rope of the rear mast 15.

Figure 3:
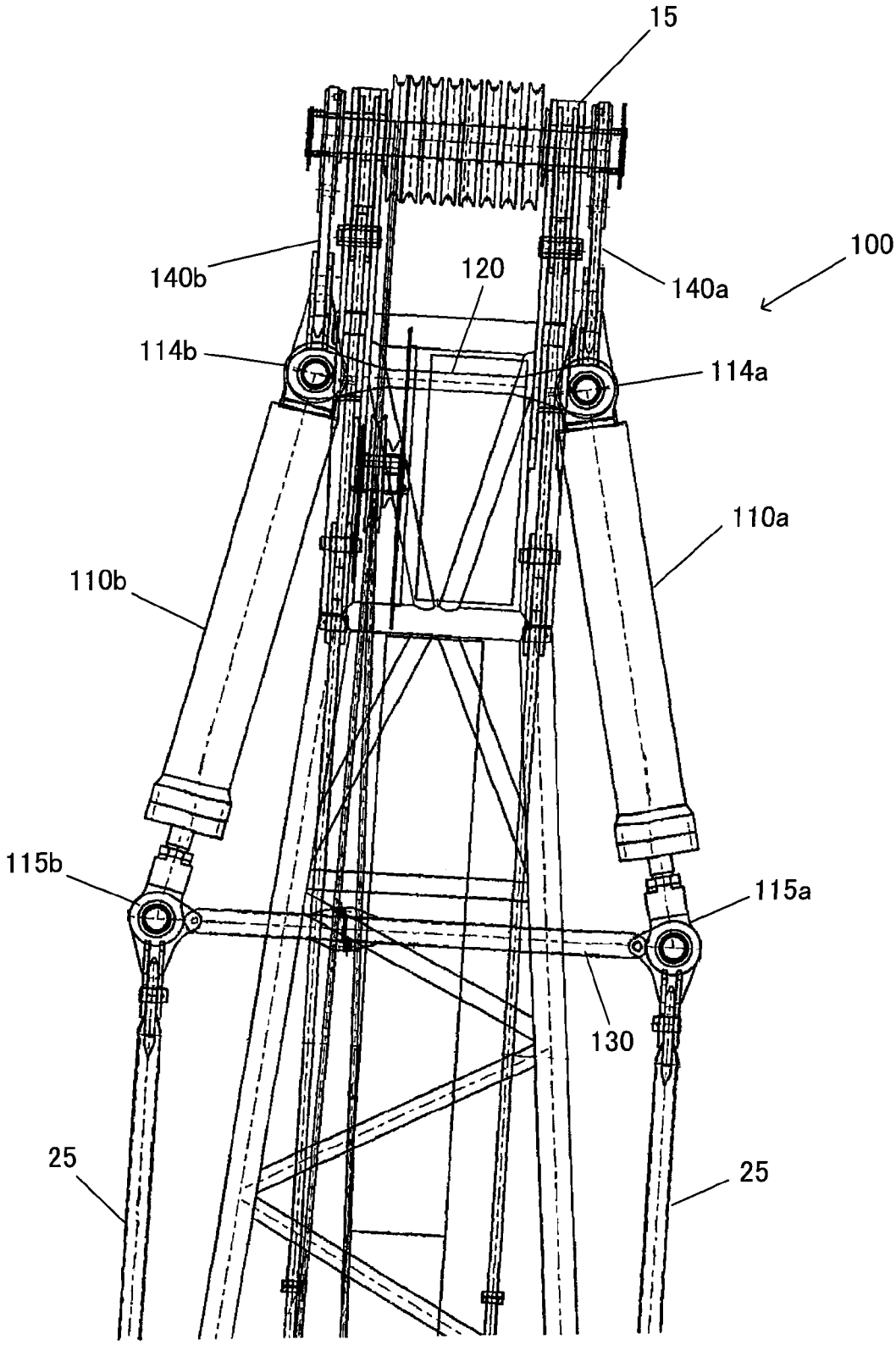
FIG. 3 is an illustration of the vicinity of the top end of a rear mast viewed from the rear.

The suspension device 100 for suspending the external weight 17 is attached to the vicinity of the top end of the rear mast 15. FIG. 3 illustrates the vicinity of the top end of the rear mast 15 viewed from the rear, with cylinder rods 113*a* and 113*b* of suspension cylinders 110*a* and 110*b* to be detailed later being contracted. The suspension device 100 includes the suspension cylinders 110*a* and 110*b*, an upper coupling member 120, a lower coupling member 130, and suspending members 140*a* and 140*b*.

The suspension cylinders 110*a* and 110*b* are hydraulic cylinders for lifting up and down the external weight 17 through a lifting member (or pendant ropes) 25, which is a member for lifting the counterweight. The suspension cylinders 110*a* and 110*b* are held at the vicinity of the top end of the rear mast 15 via the suspending members 140*a* and 140*b* with the bottom side or cap end side of the cylinders up and the rod side of the cylinders down. For ease of comprehension, the suspension cylinder provided on the right of the crane 1 is assigned with a numeral 110*a* and the suspension cylinder provided on the left of the crane 1 is assigned with a numeral 110*b*.

The suspending members 140*a* and 140*b* are, as described above, members for hanging the suspension cylinders 110*a* and 110*b* from the vicinity of the top end of the rear mast 15, with the suspension cylinder 110*a* being attached to the suspending member 140*a* and the suspension cylinder 110*b* being attached to the suspending member 140*b*. The top portions of the suspending members 140*a* and 140*b* are pivotally held in the vicinity of the top end of the rear mast 15 swingably in the fore-and-aft direction. The bottom portions of the suspending members 140*a* and 140*b* pivotally hold the end portions on the bottom side of the suspension cylinders 110*a* and 110*b* so as to support the suspension cylinders 110*a* and 110*b* swingably in the left and right direction.

End portions, or cap ends, 114*a* and 114*b* on the bottom side of the suspension cylinders 110*a* and 110*b* are coupled with each other through the upper coupling member 120. A distance between the end portions 114*a* and 114*b* on the bottom side of the suspension cylinders 110*a* and 110*b* are defined by the upper coupling member 120. End portions 115*a* and 115*b* of the cylinder rods 113*a* and 113*b* of the suspension cylinders 110*a* and 110*b* are coupled with each other through the lower coupling member 130. A distance between the end portions 115*a* and 115*b* of the cylinder rods 113*a* and 113*b* of the suspension cylinders 110*a* and 110*b* are defined by the lower coupling member 130.

The length of the upper coupling member 120 is equal to the width of the rear mast 15 in the right and left direction. The length of the lower coupling member 130 is equal to the distance between the right connection points 17*c* and the left connection points 17*d* of the external weight 17 and is greater than the length of the upper coupling member 120. The upper coupling member 120, the suspension cylinders 110*a* and 110*b*, and the lower coupling member 130 form a four-link mechanism. The link mechanism is configured to be moveable in a plane extending in the up and down direction and in the right and left direction, viewed from the rear of the crane 1. It is to be noted that when the extension lengths of the cylinder rods 113*a* and 113*b* of the right and left suspension cylinders 110*a* and 110*b* are substantially equal, the link mechanism has a trapezoidal shape, viewed from the rear of the crane 1.

The top ends of the pendant ropes 25 are connected to the end portions 115*a* and 115*b* of the cylinder rods 113*a* and 113*b* of the suspension cylinders 110*a* and 110*b*. The bottom ends of the pendant ropes 25 are, as described above, connected to the other ends of the suspending rods 17*e* and 17*f*.

Figure 4:
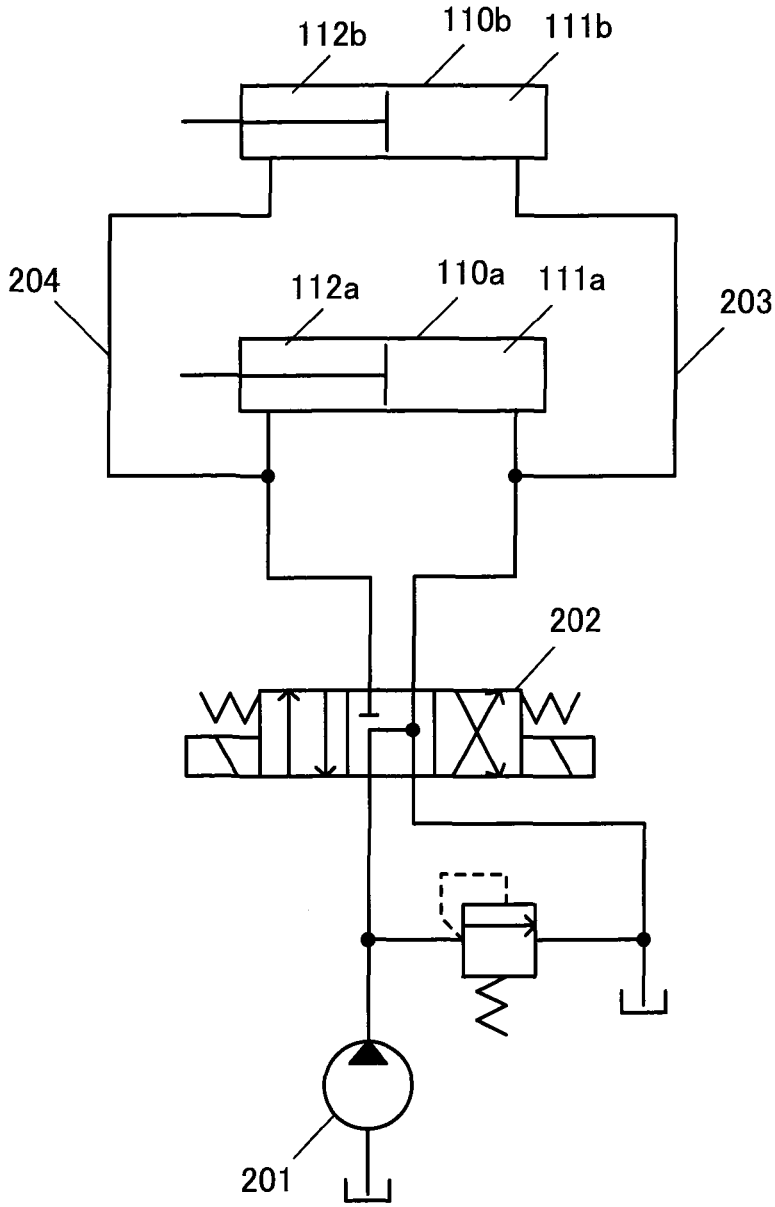
FIG. 4 is a schematic illustration of a hydraulic circuit that drives suspension cylinders.

FIG. 4 is a schematic illustration of the hydraulic circuit that drives the pair of suspension cylinders 110*a* and 110*b* of the suspension device 100. Pressure oil is supplied from a hydraulic pump 201 to each of bottom-side oil chambers 111*a* and 111*b* and rod-side oil chambers 112*a* and 112*b* of the suspension cylinders 110*a* and 110*b* through a changeover valve 202. In the suspension cylinders 110*a* and 110*b*, the bottom-side oil chambers 111*a* and 111*b* are connected in communication with each other through a first communication circuit 203 and the rod-side oil chambers 112*a* and 112*b* are connected in communication with each other through a second communication circuit 204. This allows the suspension cylinders 110*a* and 110*b* to be configured so that the bottom-side oil chambers 111*a* and 111*b* are at the same pressure and the rod-side oil chambers 112*a* and 112*b* are at the same pressure. This prevents load imbalance from occurring between the suspension cylinders 110*a* and 110*b* and inhibits horizontally uneven force to be applied to the suspension device 100 and the rear mast 15.

In the crane 1, configured as above, the cylinder rods 113*a* and 113*b* of the suspension cylinders 110*a* and 110*b* of the suspension device 100 are expanded and contracted appropriately before suspending the load. At this time, the tension of the pendant ropes 25 is adjusted so that the pendant ropes 25 are relaxed and the external weight 17 is grounded when the crane 1 suspends no load, and so that the pendant ropes 25 are strained and the external weight 17 is suspended when the crane 1 lifts too much load for the counterweight 16 alone to balance. By adjusting the tension of the pendant ropes 25 in this manner, when the boom 14 and the rear mast 15 deflect or the whole crane 1 leans forward as the crane 1 suspends too much load for the counterweight 16 alone to balance, the external weight 17 is lifted from the ground and the lifted external weight 17 gives the crane 1 the moment rotating backwards, so that the crane 1 is prevented from falling forward.

Rotation of the rotating body 13 requires the external weight 17 to be lifted from the ground. Hence, when the external weight 17 is grounded, it is necessary to contract the cylinder rods 113*a* and 113*b* of the suspension cylinders 110*a* and 110*b* so as to suspend the external weight 17. However, if the center of gravity of the external weight 17 offsets in the right and left direction from the center between the right connection points 17*c* and the left connection points 17*d*, an uneven load is applied to the right connection points 17*c* and the left connection points 17*d* when the external weight 17 is being lifted, thereby causing the external weight 17 to lean in the left and right direction.

If, for instance, the center of gravity of the external weight 17 offsets to the left from the center between the right connection points 17*c* and the left connection points 17*d*, a force acts as the left side of the external weight 17 sags below the right side thereof when the external weight 17 is suspended. If the center of gravity of the external weight 17 offsets to the right from the center between the right connection points 17*c* and the left connection points 17*d*, on the other hand, a force acts as the right side of the external weight 17 sags below the left side thereof when the external weight 17 is suspended. As a result, existing cranes require the weight members 17*a* to be reloaded so that a left-and-right offset position of the center of gravity of the external weight 17 is centered in the left and right direction. Such work for reloading the weight members 17*a* causes the crane work to be interrupted, thereby reducing work efficiency.

In the suspension device 100 of the present embodiment, on the other hand, even if the center of gravity of the external weight 17 offsets to the left or right from the center between the right connection points 17*c* and the left connection points 17*d*, the external weight 17 does not lean so much in the left and right direction when the external weight 17 is suspended. This will be explained below in detail.

Figure 5:
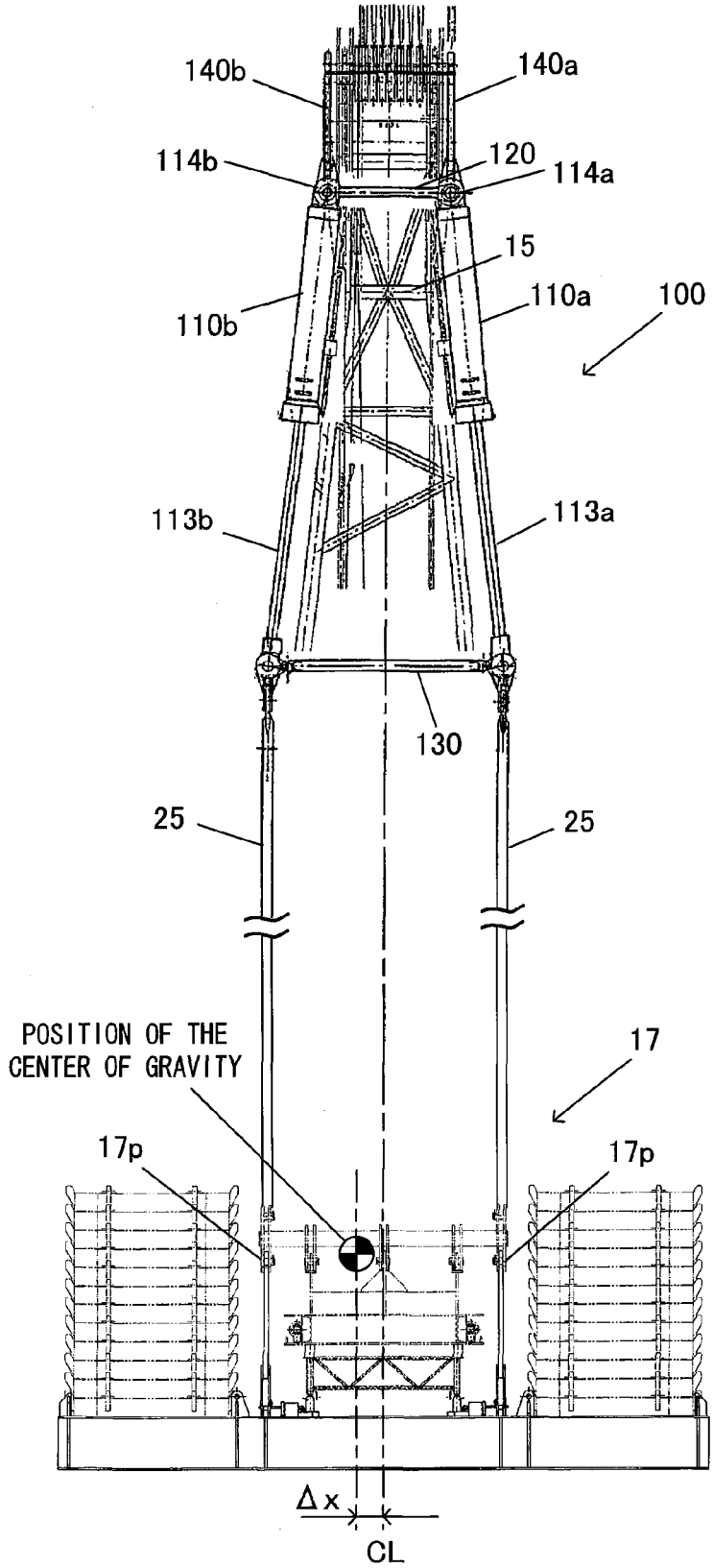
FIG. 5 illustrates an operation of the suspension device.

An explanation will now be made as to a case in which the grounded external weight 17 is to be suspended by contracting the cylinder rods 113*a* and 113*b* of the suspension cylinders 110*a* and 110*b* when the center of gravity of the external weight 17 offsets to the left by $\Delta x$ from the center CL between the right connection points 17*c* and the left connection points 17*d* as shown in FIG. 5 for example. As pressure oil is supplied to the rod-side oil chambers 112*a* and 112*b* by the changeover valve 202 being switched with an operating switch not shown in the figures, the cylinder rods 113*a* and 113*b* contract. As the contraction of the cylinder rods 113*a* and 113*b* progresses and the pendant ropes 25 are strained, reaction force from the pendant ropes 25 increases the pressure in the rod-side oil chambers 112*a* and 112*b*.

Since the rod-side oil chambers 112*a* and 112*b* are connected in communication with each other through the second communication circuit 204 as described above, further pressure oil supply preferentially contracts the cylinder rod of the suspension cylinder with less load among the suspension cylinders 110*a* and 110*b*, i.e., the cylinder rod 113*a* of the right-side suspension cylinder 110*a*, which is on the opposite side of the center of gravity offset. At this time, since the cylinder rods 113*a* and 113*b* are pulled down by the pendant ropes 25, the cylinder rods 113*a* and 113*b* are not allowed to move so much to make any difference in the heights of their ends 115*a* and 115*b*. Instead, the lower coupling member 130 moves to the left so as to accommodate the difference in lengths of the right and left cylinder rods 113*a* and 113*b*.

Since the connection beam 18 constrains the external weight 17 from moving in the left and right direction as described earlier, even if the lower coupling member 130 moves to the left so as to pull up the external weight 17 from slightly diagonally up and left, the external weight 17 does not actually move to the left. Thus, when the lower coupling member 130 has moved to the left to some extent, a force that acts to have the lower coupling member 130 returned to the right is applied to the lower coupling member 130 due to the reaction force from the pendant ropes 25. This causes the lower coupling member 130 to stop moving further to the left.

Figure 6:
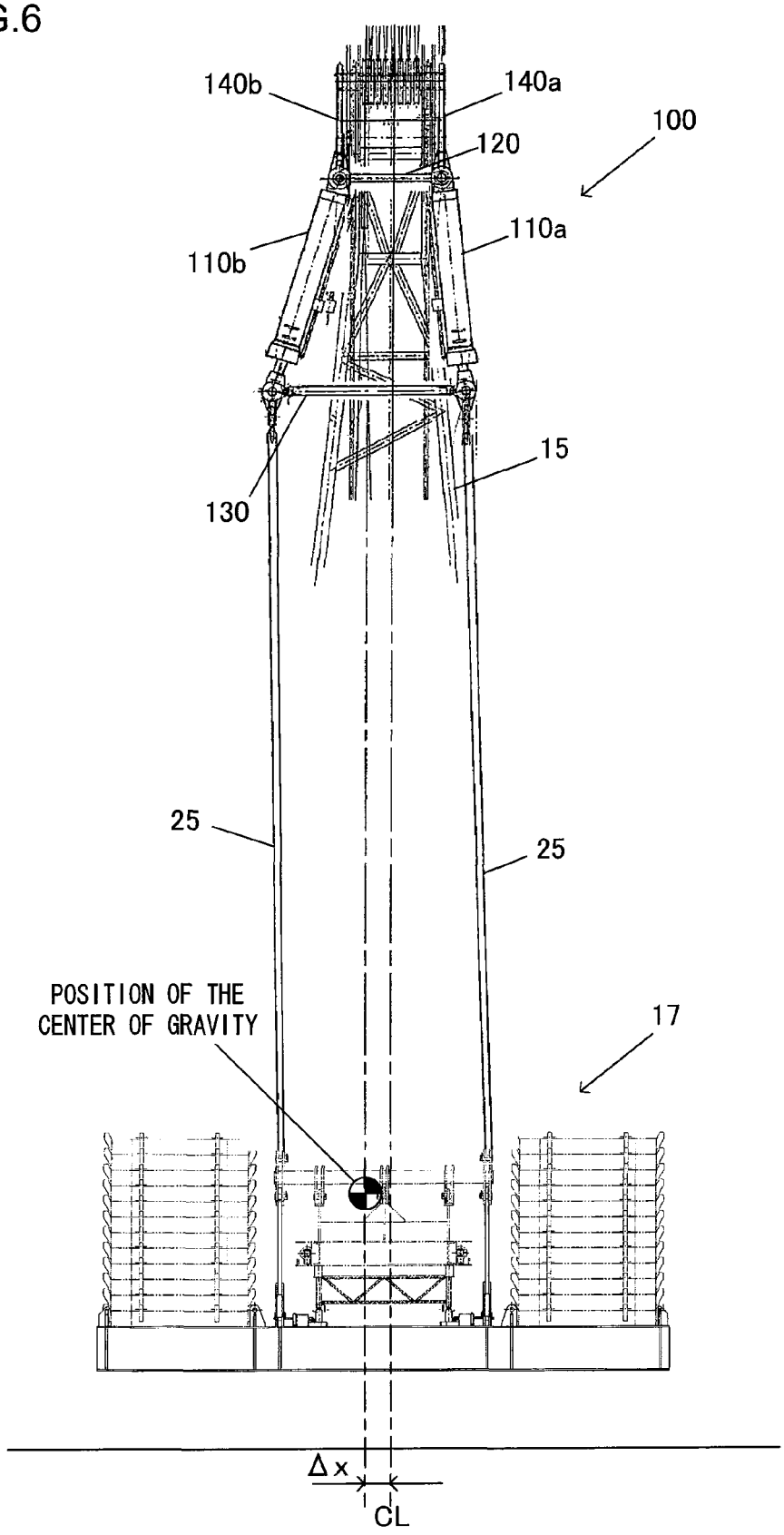
FIG. 6 illustrates an operation of the suspension device.

In addition, the force that acts to have the lower coupling member 130 returned to the right acts on the suspension cylinder 110*a* with less load as a force to expand the cylinder rod 113*a* and acts on the suspension cylinder 110*b* with greater load as a force to contract the cylinder rod 113*b*. As a result, the suspension cylinders 110*a* and 110*b* become substantially equal in load and the rod-side oil chambers 112*a* and 112*b* become substantially equal in pressure, and the right and left cylinder rods 113*a* and 113*b* will then contract in the substantially same manner. This causes, as shown in FIG. 6, the external weight 17 to move upwards without leaning too much in the left side.

It is to be noted that the same is true for a case in which too much load for the counterweight 16 alone to balance is suspended without contracting the cylinder rods 113*a* and 113*b* of the suspension cylinders 110*a* and 110*b*, so that the external weight 17 is lifted from the ground by the crane 1 leaning forward.

The following operations and advantageous effects can be achieved by the crane 1 of the present embodiment.

(1) It is arranged that the end portions 114*a* and 114*b* on the bottom side of the suspension cylinders 110*a* and 110*b* are separated laterally or in the right and left direction from one another and held independently, and the end portions 115*a* and 115*b* of the cylinder rods 113*a* and 113*b* are coupled with each other through the lower coupling member 130. The bottom-side oil chambers 111*a* and 111*b* are connected in communication with each other through the first communication circuit 203 and the rod-side oil chambers 112*a* and 112*b* are connected in communication with each other through the second communication circuit 204. This prevents the external weight 17 from leaning greatly in the left and right direction when the external weight 17 is suspended even if the position of the center of gravity of the external weight 17 offsets in the left and right direction. As a result, since it is not necessary to reload the weight members 17*a* even if the position of the center of gravity of the external weight 17 offsets in the left and right direction, work efficiency of the crane work is improved.

(2) It is arranged that the length of the lower coupling member 130 is greater than that of the upper coupling member 120. As a result, even if the left and right cylinder rods 113*a* and 113*b* of the suspension cylinders 110*a* and 110*b* become uneven in length for some extent due to offset of the position of the center of gravity of the external weight 17, the cylinder rods 113*a* and 113*b* are prevented from being more uneven in length, and thus, leaning of the external weight 17 is inhibited.

(3) The link mechanism is arranged by coupling the end portions 114*a* and 114*b* on the bottom side of the suspension cylinders 110*a* and 110*b* with each other through the upper coupling member 120 and by coupling the end portions 115*a* and 115*b* of the cylinder rods 113*a* and 113*b* with each other through the lower coupling member 130. As a result, since the separation between the suspension cylinders 110*a* and 110*b* in the left and right direction can be defined at the top and the bottom, that is, two vertically separated locations, of the suspension cylinders 110*a* and 110*b* and no force in the radial direction is applied to the suspension cylinders 110*a* and 110*b*, the life of the suspension cylinders 110*a* and 110*b* will not be shortened.

—Variations—

(1) While in the above explanation, the length of the upper coupling member 120 is arranged to be equal to the width of the rear mast 15 in the left and right direction and the length of the lower coupling member 130 is arranged to be equal to the separation between the right connection points 17*c* and the left connection points 17*d* of the external weight 17, the present invention is not limited thereto. The length of the lower coupling member 130 may be defined so that the end portions 115*a* and 115*b* of the cylinder rods 113*a* and 113*b* are located at least outside of the space defined between a first line and a second line to be described later even if the lower coupling member 130 is moved in the left and right direction when the external weight 17 is suspended. Here, the first line refers to a straight line connecting the end portion 114*a* on the bottom side of the suspension cylinder 110*a* with the connection point 17*p* at which the other ends of the suspending rods 17*e* and 17*f* connected to the right connection points 17*c* are coupled with each other. The second line refers to a straight line connecting the end portion 114*b* on the bottom side of the suspension cylinder 110*b* with the connection point 17*p* at which the other ends of the suspending rods 17*e* and 17*f* connected to the left connection points 17*d* are coupled with each other.

(2) While in the above explanation, it is arranged that the end portions 114*a* an 114*b* on the bottom side of the suspension cylinders 110*a* and 110*b* are located up and the end portions 115*a* and 115*b* of the cylinder rods 113*a* and 113*b* are located down, the present invention is not limited thereto. In other words, it may be arranged that the end portions 114*a* and 114*b* on the bottom side of the suspension cylinders 110*a* and 110*b* are located down and the end portions 115*a* and 115*b* of the cylinder rods 113*a* and 113*b* are located up.

(3) While in the above explanation, an example of the mobile crane 1 was explained, the present invention is not limited thereto, i.e., it may be applied to a non-mobile crane.

(4) The embodiments and variations described above may each be adopted in combination.

It is to be noted that the present invention may be embodied in any way other than those described in reference to the embodiments, and includes counterweight suspension devices with a variety of structures and mobile cranes with a variety of structures that include the suspension devices comprising a pair of suspension cylinders that suspends a counterweight, and that are hung from a first and a second hanging points provided separately in a left and right direction at a top end of a rear mast; a coupling member that couples cylinder rod ends of the pair of suspension cylinders with each other; a lifting member for lifting the counterweight, that connects a first and a second connection points of the counterweight with each of cylinder rod ends of the pair of suspension cylinders, with the first and the second connection points provided separately in the left and right direction on the counterweight for attaching the lifting member to the counterweight; a first communication circuit through which rod chambers of the pair of suspension cylinders communicate with each other; and a second communication circuit through which bottom chambers of the pair of suspension cylinders communicate with each other.

What is claimed is:

1. A counterweight suspension device, comprising:

a first suspension cylinder that is hung from a first hanging point and a second suspension cylinder that is hung from a second hanging point, with the first suspension cylinder and the second suspension cylinder configured to suspend a counterweight, and with the first hanging point and the second hanging point being provided separately in a left and right direction at a top end of a rear mast;

a coupling member that couples a cylinder rod end of the first suspension cylinder and a cylinder rod end of the second suspension cylinder;

a first lifting member and a second lifting member for lifting the counterweight, wherein the first lifting member connects a first connection point of the counterweight with the cylinder rod end of the first suspension cylinder and the second lifting member connects a second connection point of the counterweight with the cylinder rod end of the second suspension cylinder, with the first and the second connection points provided separately in the left and right direction on the counterweight for attaching the first lifting member and the second lifting member to the counterweight;

a first communication circuit through which rod chambers of the first and second suspension cylinders communicate with each other;

a second communication circuit through which bottom chambers of the first and second suspension cylinders communicate with each other; and a changeover valve that is operated to one of a lifting position for lifting the counterweight, a lowering position for lowering the counterweight and a neutral position, wherein pressure oil from a hydraulic pump is supplied to the first communication circuit via the changeover valve in the lifting position, the pressure oil from the hydraulic pump is supplied to the second communication circuit via the changeover valve in the lowering position, and the first communication circuit is blocked by the changeover valve in the neutral position; wherein the coupling member extends in a direction substantially transverse to the first lifting member and the second lifting member.

2. The counterweight suspension device according to claim 1, wherein:

a length of the coupling member is defined so that both ends of the coupling member are placed outside of a space defined between straight lines connecting the first and the second hanging points with the first and the second connection points, respectively.

3. The counterweight suspension device according to claim 2, further comprising:

an upper coupling member, which is shorter than the coupling member, that couples cap ends of the first and second suspension cylinders with each other.

4. The counterweight suspension device according to claim 1, wherein:

the first and second suspension cylinders are held swingably in the left and right direction.

5. The counterweight suspension device according to claim 1, wherein:

a length of the coupling member is equal to a distance between the first and the second connection points.

6. A mobile crane, comprising:

the counterweight suspension device according to claim 1;

a traveling undercarriage;

a rotating superstructure that is provided rotatably upon the traveling undercarriage;

the rear mast that is attached to the rotating superstructure; and a connection beam that allows the counterweight to move in an up and down direction and constrains the counterweight from moving in the left and right direction with respect to the rotating superstructure.

7. The mobile crane according to claim 6, further comprising:

a boom that is attached to the rotating superstructure; and a supporting pendant rope that connects a top end of the boom with the rear mast.

* * * * *